US008376796B1

(12) United States Patent
Vock

(10) Patent No.: US 8,376,796 B1
(45) Date of Patent: Feb. 19, 2013

(54) STEP-IN SWIM FIN BINDING SYSTEM

(76) Inventor: Frank Vock, Windom, MN (US)

( * ) Notice: Subject to any disclaimer, the term of this patent is extended or adjusted under 35 U.S.C. 154(b) by 390 days.

(21) Appl. No.: 12/752,666

(22) Filed: Apr. 1, 2010

Related U.S. Application Data

(60) Provisional application No. 61/211,803, filed on Apr. 4, 2009.

(51) Int. Cl.
*A63B 31/08* (2006.01)

(52) U.S. Cl. ..... 441/64

(58) Field of Classification Search ..... 441/61, 441/62, 63, 64; 36/8.1; D21/806
See application file for complete search history.

(56) References Cited

U.S. PATENT DOCUMENTS

| | | | | |
|---|---|---|---|---|
| 5,041,039 | A * | 8/1991 | Chang | 441/64 |
| 5,324,219 | A * | 6/1994 | Beltrani et al. | 441/64 |
| 5,593,333 | A * | 1/1997 | Johnson | 441/62 |
| 5,879,212 | A * | 3/1999 | Kennedy | 441/64 |
| 6,227,923 | B1 * | 5/2001 | Johnson | 441/61 |
| 7,048,601 | B2 * | 5/2006 | Sclafani | 441/64 |

* cited by examiner

*Primary Examiner* — Lars A Olson
(74) *Attorney, Agent, or Firm* — Mark A Mersereau

(57) ABSTRACT

A diving fin system possessing two independent subunits, a fin subunit and a shoe subunit. The two subunits are reversibly fastened through a mechanism whereby the fin subunit possesses a front fin clip and a back locking clip, and the shoe subunit possesses a front receiver for the front fin clip and a back locking pin to cooperatively engage the back locking clip of the fin.

8 Claims, 7 Drawing Sheets

STEP-IN SWIM FIN BINDING SYSTEM

This application claims priority of U.S. provisional application 61/211,803, filed Apr. 4, 2009.

BACKGROUND OF THE INVENTION

Traditionally, a diving swim fin system comprises a diving fin and diving bootie. The bootie is most often composed of Neoprene (polychloroprene) and possesses a rubberized sole. It is generally designed for use only during diving activities. The bootie is not designed for extensive use outside of the diving activity.

Currently, diving fins are designed to have a water scoop section for propulsion through water, a generally concave section for cooperatively engaging a foot (or foot with bootie), and a fastening strap unit that engages the heel of the foot and maintains the foot in contact with the generally concave section of the fin.

SUMMARY OF THE INVENTION

The current invention is generally related to a step-in swim fin binding system. The system comprises a specially designed shoe, containing fastening elements built into the sole of the shoe, and a specially designed swim fin, containing clamping elements built into the upper surface of the fin. The configuration allows the user to quickly attach the fin to the shoe with a step-in motion by utilizing a binding system comprising the following elements. The system has a shoe subunit comprising, a shoe upper, a shoe sole, a shoe toe clip receiver and a shoe heel fastener element. It further contains a swim fin subunit comprising, a base plate, a fin toe clip, and a fin heel clip. Wherein, the fin toe clip reversibly contacts the shoe toe clip receiver, and the fin heel clip reversibly contacts the shoe heel fastener to fasten the shoe subunit to the swim fin subunit.

DETAILED DESCRIPTION

One embodiment of the inventive system is a swim fin 100 with fin binding system that allows for removably fastening a shoe 101.

Figure 1:
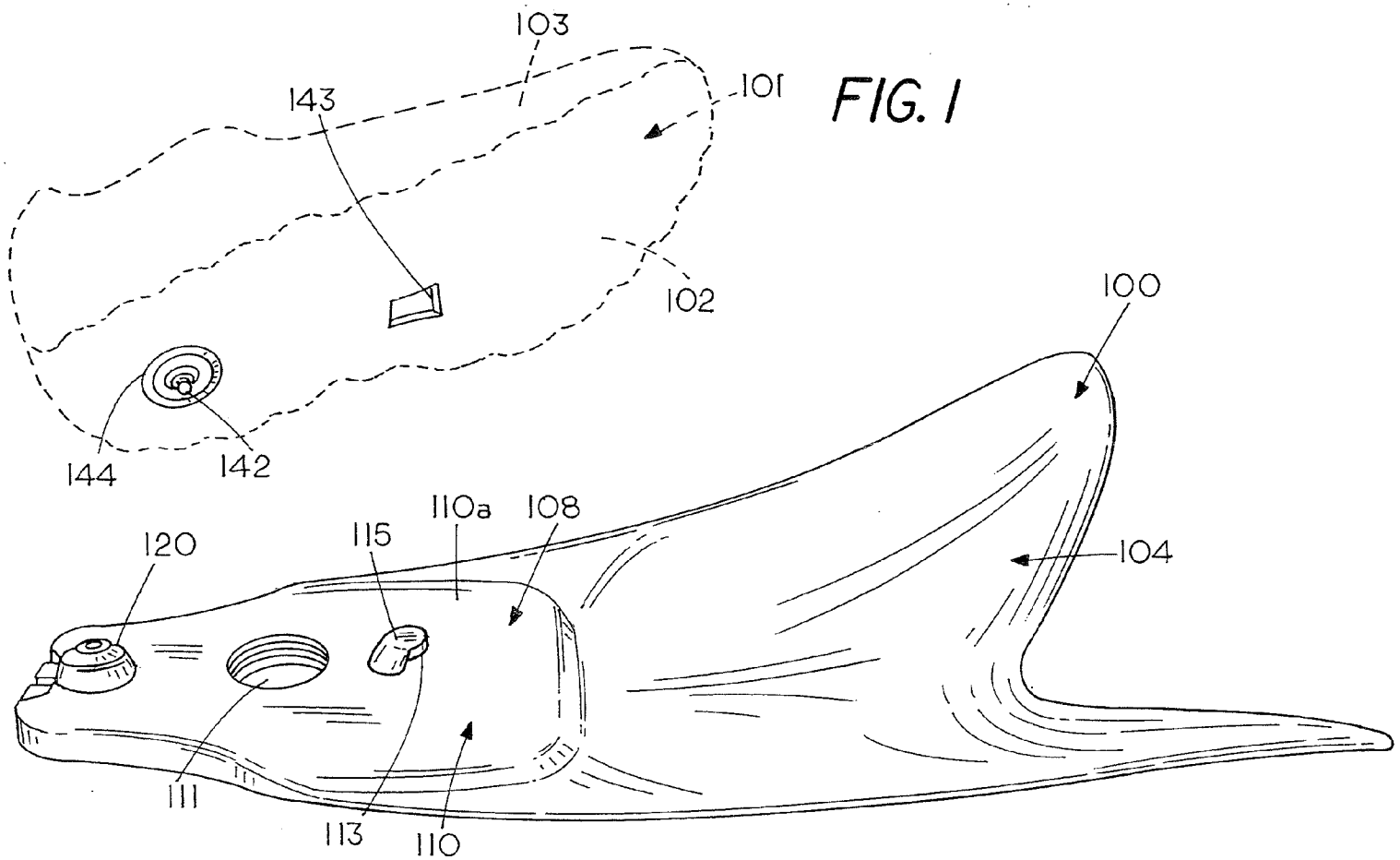
FIG. 1 is a perspective view of an embodiment of a swim fin with fastening system and shoe according to the present invention.

As seen in FIG. 1, the fin 100 possesses two regions, a water scoop region 104 utilized for propulsion through water, and a shoe mounting region 108, adapted for reversibly fastening to the shoe 101. Together, the scoop region 104 and the shoe mounting region 108 are integrally formed and produce the entirety of the fin 100.

As seen in FIG. 1, the shoe mounting region 108 comprises a plurality subcomponents. A first subcomponent is a base plate 110 comprising an upper surface 110*a*, and a water drainage void 111 cut through the base plate 110 of the fin. A second subcomponent is a fin toe clip 115 that is integrally formed with the base plate upper surface 110*a*. A third component in FIG. 1 is a fin heel clip 120 that is integrally formed with the base plate upper surface 110*a*.

The base plate 110 is integrally formed and contiguous with the scoop region 104. The base plate 110 comprises a hardened support material that possess properties adequate to accommodate structurally supporting a shoe binding system while allowing for integral formation with the scoop region 104.

The fin toe clip 115 can be made from a variety of materials, including high impact plastics or non-corrosive metals. The fin toe clip 115, has a generally inverted "L" shaped designed. It provides a hook fastening function through the toe clip engagement arm 113. The fin toe clip 115 is fastened to the base plate 110 in a variety of fashions. For example, the fin toe clip 115 may be integrally formed with the base plate 110 to form a fixed fastener attachment, as seen in FIG. 1.

The FIG. 1 embodiment also includes a second fastener, the fin heel clip 120, which is integrally formed with the upper surface 110*a* of the base plate 110. The fin heel clip 120 is generally designed as the female half of a male/female fastener system. The fin heel clip 120 is generally mounted within a raised, downward facing, concave cavity section of the base plate upper surface 110*a* at or near the heel of the fin. (shown in greater detail in FIGS. 6 and 8)

The embodiment depicted in FIG. 1 also shows shoe elements of the embodiment. A shoe heel fastener element 142 is the corresponding male half of the male/female fastening system. The shoe heel fastener element 142 is located at or near the heel section of the shoe's sole. The shoe 101, comprising a shoe sole 102 and a shoe upper 103 also contains a shoe toe clip receiver element (discussed in full detail below, element 141).

Figure 2:
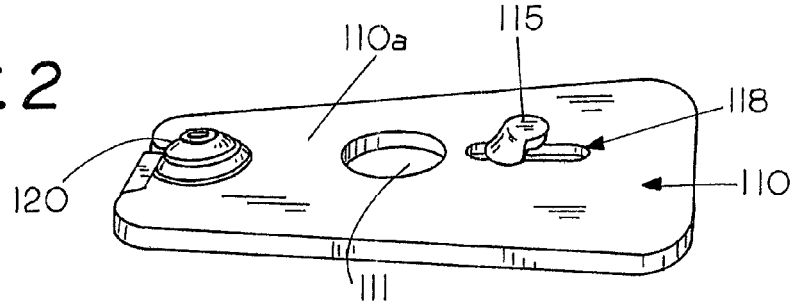
FIG. 2 is a perspective view of an embodiment of a swim fin base plate and fastening system according to the present invention.
Figure 3:
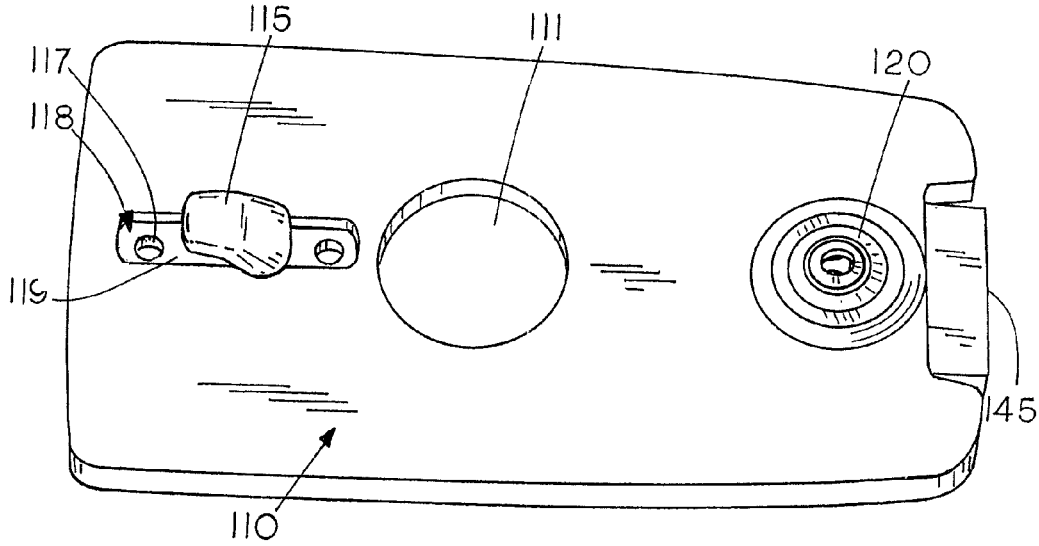
FIG. 3 is a perspective view of an embodiment of a swim fin base plate and fastening system with an adjustable toe component according to the present invention.
Figure 4:
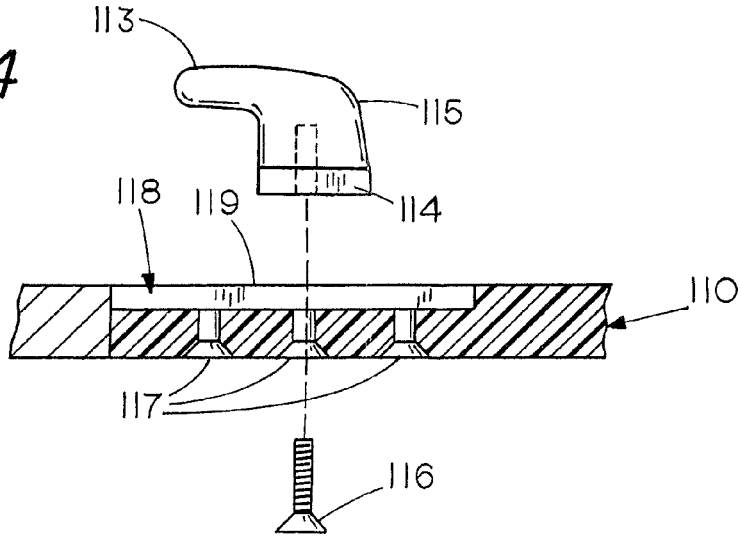
FIG. 4 is a side view of an embodiment of a swim fin base plate with an adjustable toe component according to the present invention.

A second fin base plate 110 embodiment, as seen in FIG. 2, possesses a fin toe clip 115 with an adjustable mounting mechanism 118 formed within the fin base plate 110.

The fin toe clip 115, as seen in FIGS. 2, 3, 4, and 5, may be fastened to the base Plate 110 with a screw 116, thus allowing adjustable placement of the fin toe clip 115 to accommodate a variety of shoe sizes. Where an adjustable fin toe clip 115 is utilized, the fin toe clip 115 possesses a tongue 114 that is sized to cooperatively fit within a groove 119 that is cut into the upper surface of the base plate 110. The groove 119, provides lateral support for the fin toe clip 115. Also, a series of holes 117 are bored into the base plate 110 and internal to the groove 119, to accommodate the screw 116 used to adjustably attach the fin toe clip 115 to the fin base plate 110.

Figure 5:
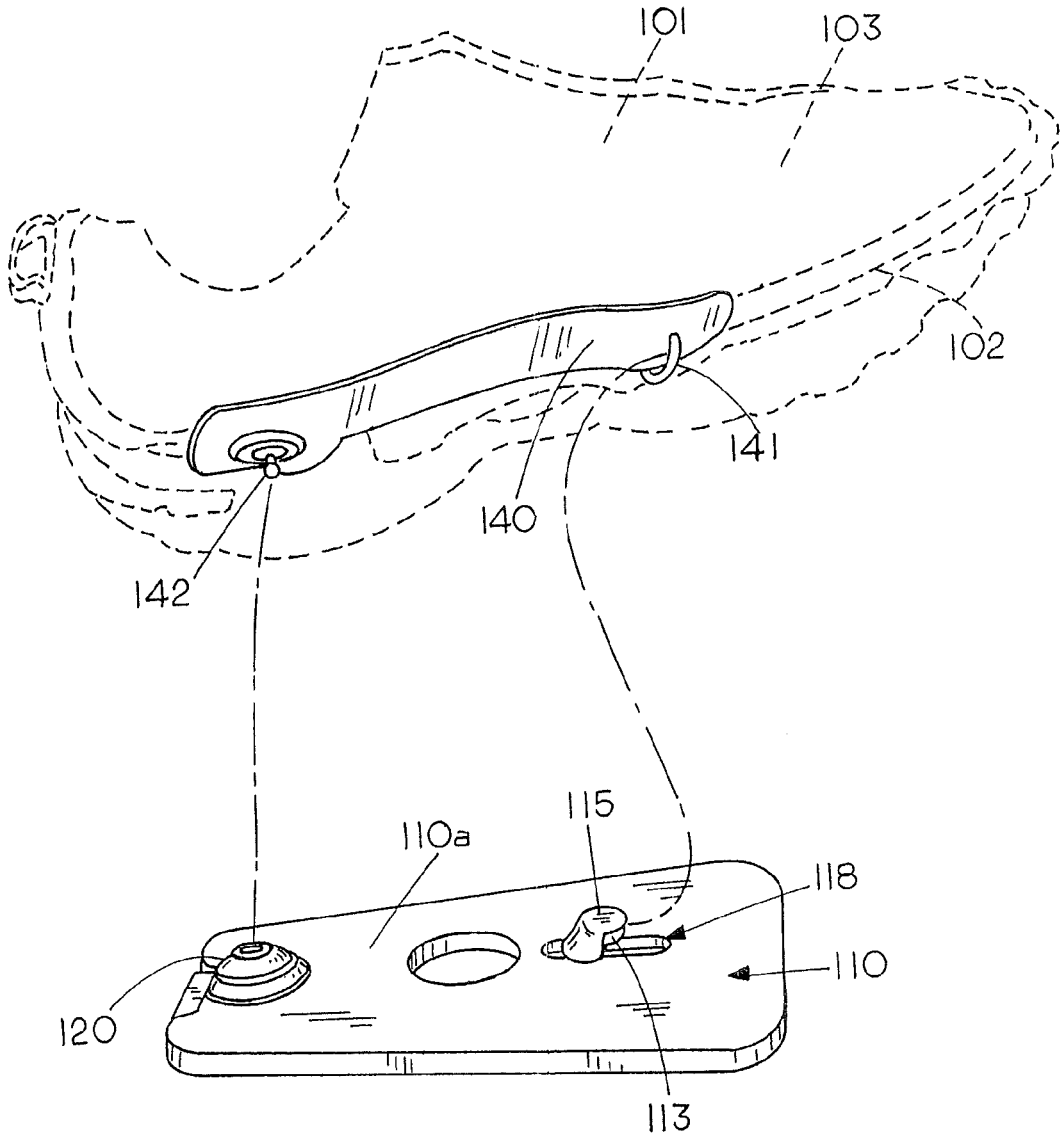
FIG. 5 is a perspective view of an embodiment of a swim fin fastening system with an adjustable component and shoe fastening system according to the present invention.

As seen in FIG. 5, the fastening system utilizes a shoe insert body 140 that can be made from a variety of rigid materials such as plastic, nylon, fiberglass, etc. The shoe insert body 140 is integrated with the sole of the shoe 102. The shoe insert 140 possesses a shoe toe clip receiver 141 and the shoe heel fastener element 142.

The shoe toe clip receiver 141 is integrally molded with the shoe insert body 140. The shoe toe clip receiver 141 is designed to reside within a first concave depression 143 (as seen in FIG. 1) in the bottom surface of the shoe's sole 102. The shoe toe clip receiver 141 is a concave molding on the bottom surface of the shoe insert body 140. The shoe toe clip receiver 141 is designed to cooperatively and reversibly engage the toe clip engagement arm 113.

The toe clip engagement arm 113 cooperatively fits within the concave configuration of the shoe toe clip receiver 141 in such a manor that allows the user to release the fin from the shoe and remove the fin by pulling the fin toward the user. This improves the ease of fin release relative to the current art. Standard fin configurations require the user to pull the fin forward and away from the user's body to remove the fin from the foot.

Also shown in FIG. 5, the shoe heel fastener element 142 is fixedly fastened to the shoe insert body by rivet (not shown), or fixedly fastened by a threaded bolt and nut system (described in detail below), or other similar fastening means. The shoe heel fastener element 142 resides within a downward facing, second concave depression 144 (as seen in FIG. 1) in the bottom surface of the shoe's sole 102.

The shoe heel fastener element 142 and the shoe toe clip receiver 141, reside in the second concave depression 144 and first concave depression 143, respectively, within the shoe's sole 102. Neither fastening element projects externally beyond their respective depressions. Thus, the shoe may be worn during activities outside of the diving activity without damaging the binding elements. This allows the diver to transition from the dive to other activities (or vise versa) without the need to immediately change into different footwear.

Figure 6:
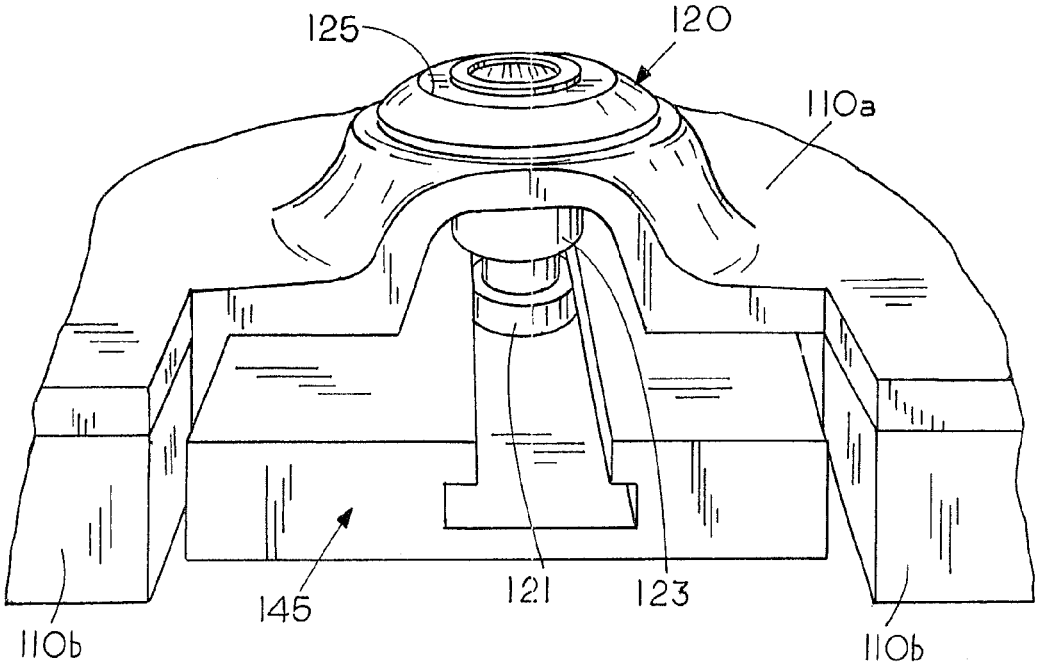
FIG. 6 is a cutaway view of an embodiment of a swim fin fastener component according to the present invention.
Figure 7:
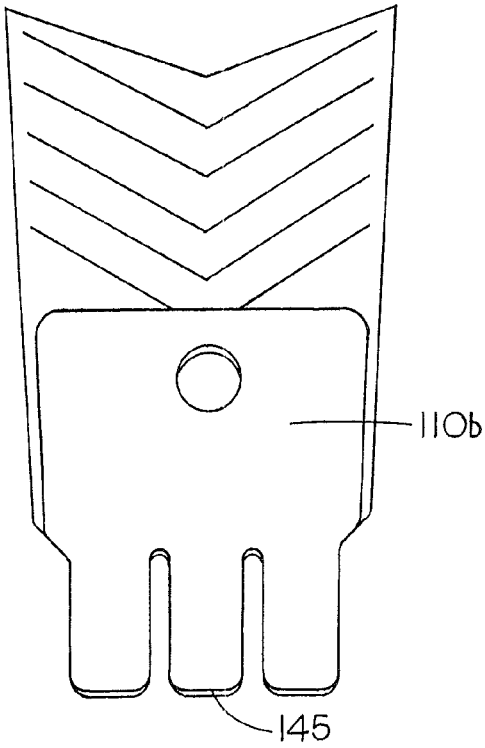
FIG. 7 is a bottom view of an embodiment of a swim fin according to the present invention.

As seen in FIGS. 6 and 7, the base plate 110 includes a hinged tab 145 integrally formed with the base plate lower surface 110*b* (as specifically seen in FIG. 6). As seen in FIG. 6, the hinged tab 145 operates to engage a plunger 121 subcomponent of the fin heel clip 120. A downward movement of the hinged tab 145 displaces the plunger 121 and disengages the fin heel clip 120 from the shoe heel fastener element 142 when the two elements are in the engaged/fastened configuration.

Figure 8:
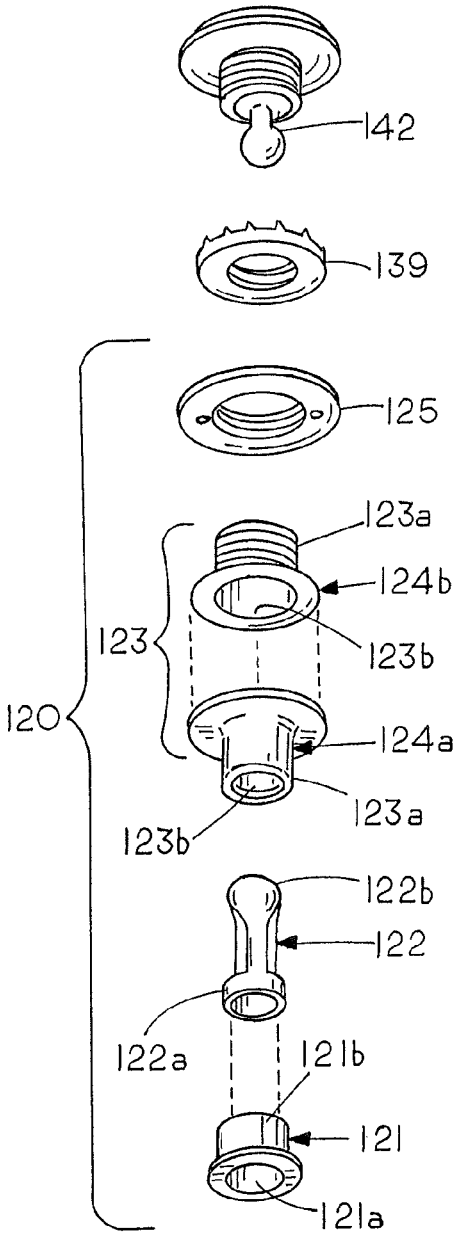
FIG. 8 is an exploded view of an embodiment of a swim fine fastening component according to the present invention.

As seen in FIGS. 8 and 9, a detailed view of the reversible locking mechanism is provided. The male shoe heel fastener element 142 is of such configuration to cooperatively and reversibly engage a female clamp 122 subunit of the fin heel clip 120 to securely fasten the shoe 101 to the fin 100.

Figure 9A:
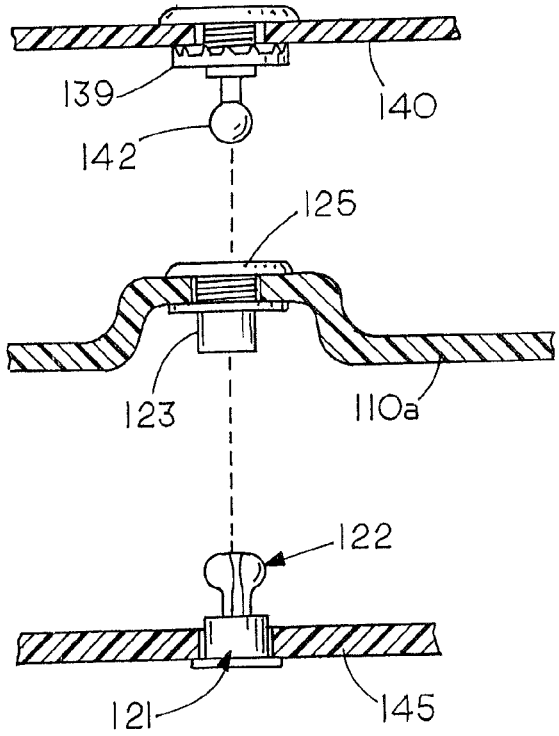
FIG. 9*a* is a cutaway, side view of the individual components of an embodiment of a swim fin fastening system base plate according to the present invention.
Figure 9B:
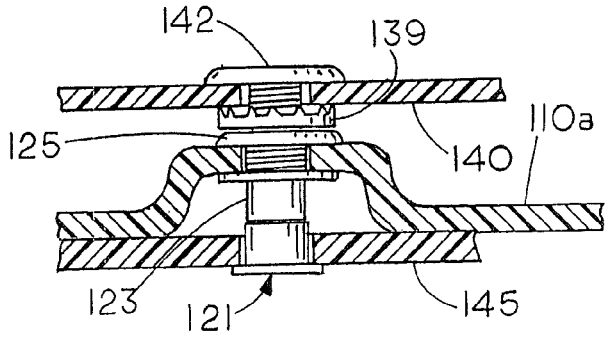
FIG. 9*b* is a cutaway, side view of the engaged position of individual components of an embodiment of a swim fin fastening system base plate according to the present invention.

The fin heel clip 120 is designed with a plurality of subunits. As seen FIGS. 8, 9*a*, and 9*b*, one embodiment comprises the plunger 121 and female clamp 122 subunit. The plunger 121 is configured to possess a hollow, central void 121*a* defined by plunger sidewalls 121*b*. This configuration is unique in that the hollow configuration allows water to flow through the plunger subunit and prevents jamming of the clamp. The plunger sidewalls 121*b* also provide a means by which to integrally mount the subunit to the hinge tab 145, as seen in FIG. 9*a*.

The plunger 121 cooperatively engages the female clamp 122 subunit. The female clamp subunit 122 possesses a clamp base 122*a*. The clamp base 122*a* cooperatively engages the plunger sidewalls 121*b* within the plunger central void 121*a*, and the two elements are fixedly attached by crimping, welding, or other fastening means known in the art. The resulting cooperation between the plunger 121 and the female clamp 122 allows for releasing the female clamp 122 from the engaged positions by pressing down on the hinged tab 145.

The female clamp 122 also possesses clamping arms 122*b*. The clamping arms 122*b* reside within a heel clip housing 123. The heel clip housing 123 comprises a lower heel clip housing 124*a* and an upper heel clip housing 124*b*. The heel clip housing 123 possesses housing sidewalls 123*a* which defines a heel clip housing hollow central void 123*b*. The heel clip housing central void 123*b* maintains the clamping arms 122*b* in proper position and alignment to function as a fastening system between the swim fin and target shoe. The heel clip housing 123 also provides a means by which to integrally mount the heel clip 120 with the upper surface 110*a* of the base plate 110. The housing 123 may be molded into the base plate top surface 110*a* (not shown).

Another embodiment of the heel clip housing 123 includes a threaded fastening system, as seen in FIG. 8, and a threaded nut fastener 125 to secure the heel clip housing 123 to the base plate 110 at the upper surface 110*a*.

Figure 10:
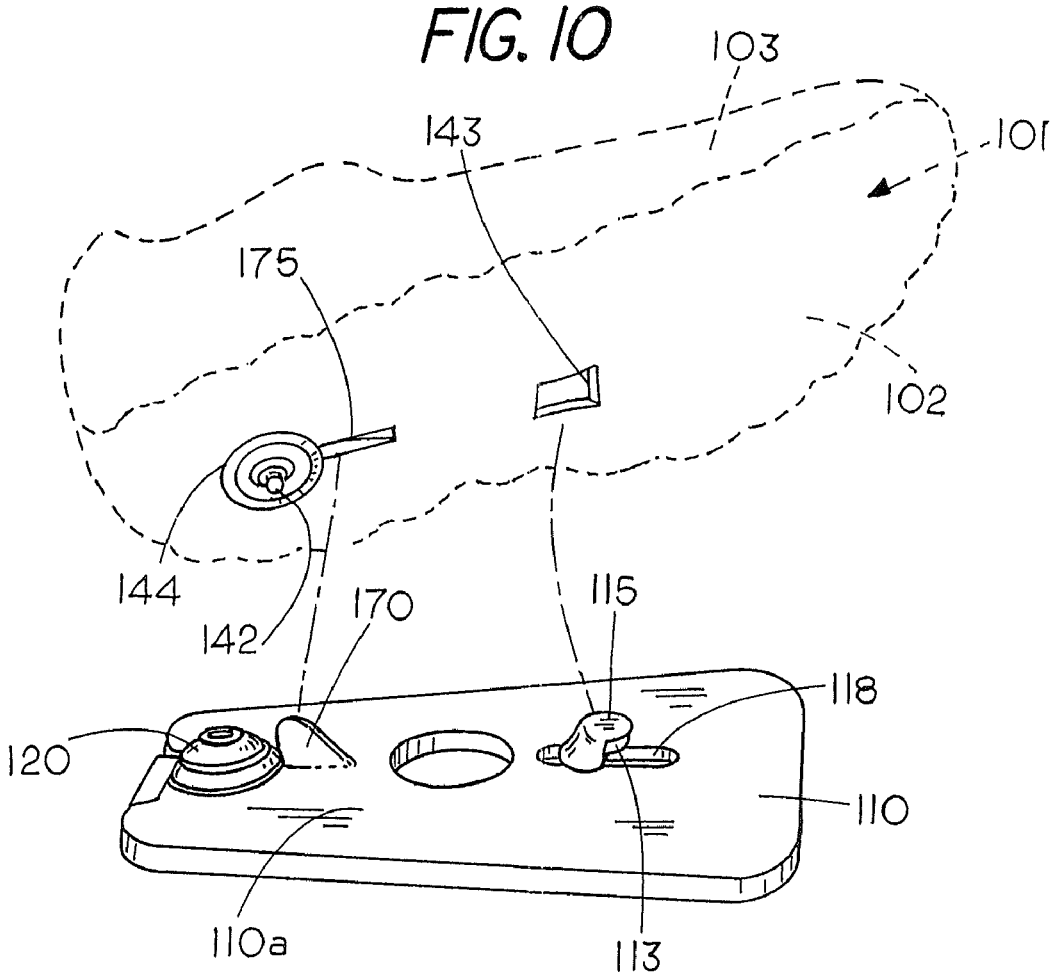
FIG. 10 is a perspective view of an embodiment of a swim fin with fastening system and shoe according to the present invention.
Figure 11A:
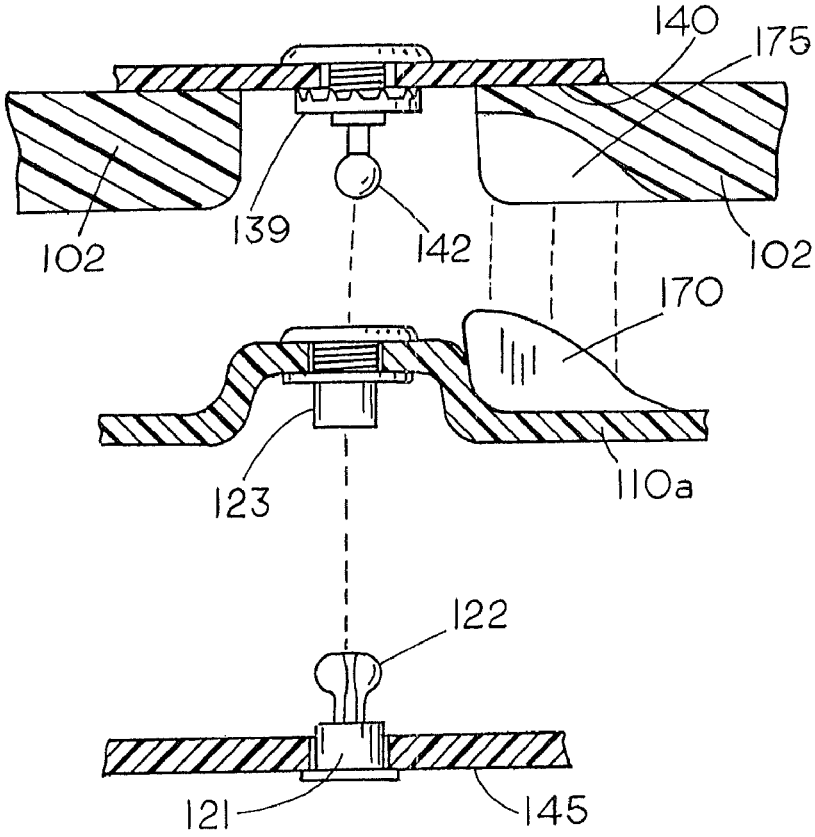
FIG. 11*a* is a cutaway, side view of the individual components of an embodiment of a swim fin fastening system base plate according to the present invention.
Figure 11B:
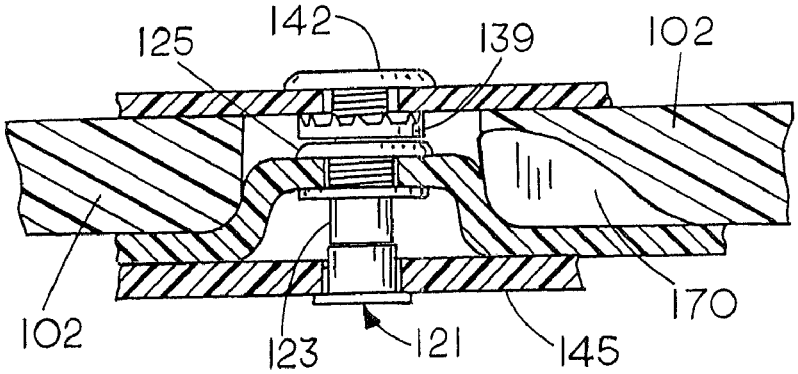
FIG. 11*b* is a cutaway, side view of the engaged position of individual components of an embodiment of a swim fin fastening system base plate according to the present invention.

Another embodiment, seen in FIGS. 10 and 11, includes a modified fin base plate upper surface 110*a*. The fin base plate upper surface 110*a* further includes a male shoe guide 170. The male shoe guide 170 is generally fin shaped and integrally formed with the base plate upper surface 110*a* at or near the heel clip 120. The male shoe guide 170 functions to properly guide the male shoe heel fastener element 142 into the engaged position with the female clamp 122. The male shoe guide 170 accomplishes this function by cooperatively engaging a female shoe guide 175 integrally formed within the sole of the shoe 102 at or near the second concave depression 144. The guiding function facilitates the step-in function of the binding system.

What is claimed is:

1. A swim fin binding system comprising:

a. a shoe subunit comprising a shoe upper, a shoe sole, a shoe toe clip receiver and a shoe heel fastener element;

b. a swim fin subunit comprising a base plate, a fin toe clip, and a fin heel clip comprising a female half of a male/female locking mechanism possessing a means to flush debris from the female half of said locking mechanism; wherein the fin heel clip locking mechanism is effectuated through the use of a hinged tab; wherein, the fin toe clip reversibly contacts the shoe toe clip receiver, and the fin heel clip reversibly contacts the shoe heel fastener to fasten the shoe subunit to the swim fin subunit.

2. The swim fin binding system of claim 1 wherein the shoe heel fastener element is the male half of the male/female locking mechanism.

3. The swim fin binding system of claim 2 wherein the shoe toe clip receiver resides within a first downward facing, concave depression in the shoe sole.

4. The swim fin binding system of claim 3 wherein the shoe heel fastener element resides within a second downward facing, concave depression in the shoe sole.

5. A swim fin binding system comprising:

a. a shoe subunit comprising a shoe upper, a shoe sole, a shoe toe clip receiver and a shoe heel fastener element, wherein the shoe sole includes an integrally formed female shoe guide within the sole of the shoe;

b. a swim fin subunit comprising a base plate, wherein the base plate further includes and integrally formed male shoe guide, a fin toe clip, and a fin heel clip comprising a female half of a male/female locking mechanism possessing a means to flush debris from the female half of said locking mechanism; wherein, the fin toe clip reversibly contacts the shoe toe clip receiver, and the fin heel clip reversibly contacts the shoe heel fastener to fasten the shoe subunit to the swim fin subunit; and the fin heel clip locking mechanism is effectuated through the use of a hinged tab.

6. The swim fin binding system of claim 5 wherein the shoe heel fastener element is the male half of the male/female locking mechanism.

7. The swim fin binding system of claim 6 wherein the shoe toe clip receiver resides within a first downward facing, concave depression in the shoe sole.

8. The swim fin binding system of claim 7 wherein the shoe heel fastener element resides within a second downward facing, concave depression in the shoe sole.

* * * * *